US005231810A

United States Patent [19]

Buhay et al.

[11] Patent Number: 5,231,810

[45] Date of Patent: Aug. 3, 1993

[54] CEILING BOARD APERTURE

[75] Inventors: Barry Buhay; Walter W. Chamberlain, III; Donald F. Claussen, all of Lancaster, Pa.

[73] Assignee: Armstrong World Industries, Inc., Lancaster, Pa.

[21] Appl. No.: 873,622

[22] Filed: Apr. 23, 1992

Related U.S. Application Data

[63] Continuation of Ser. No. 536,350, Jun. 11, 1990, abandoned.

[51] Int. Cl.[5] ..... E04C 9/00

[52] U.S. Cl. ..... 52/220.6; 52/220.8; 52/316

[58] Field of Search ..... 52/311, 484, 220, 22, 52/39, 337, 316, 605; 362/150, 364; D25/138, 145, 157, 220.1, 220.6, 220.8

[56] References Cited

U.S. PATENT DOCUMENTS

| | | | |
|---|---|---|---|
| 1,129,637 | 2/1915 | Cameron | 52/98 |
| 2,035,902 | 3/1936 | MacLeod | 52/454 |
| 3,030,093 | 4/1962 | Reintjes | 52/606 |
| 3,332,194 | 7/1967 | Jack | 52/592 |
| 3,721,050 | 3/1973 | Perina | 52/28 |
| 3,848,385 | 11/1974 | Thompson | 52/28 |
| 4,885,889 | 12/1989 | Hemphill et al. | 52/311 X |

*Primary Examiner*—Carl D. Friedman
*Assistant Examiner*—Robert J. Canfield

[57] ABSTRACT

The invention is a ceiling board with a factory cut aperture therein. The edges of the ceiling board and/or the edges of a design cut in the face of the board are of the same or compatible design to that of the edge(s) of the aperture.

5 Claims, 2 Drawing Sheets

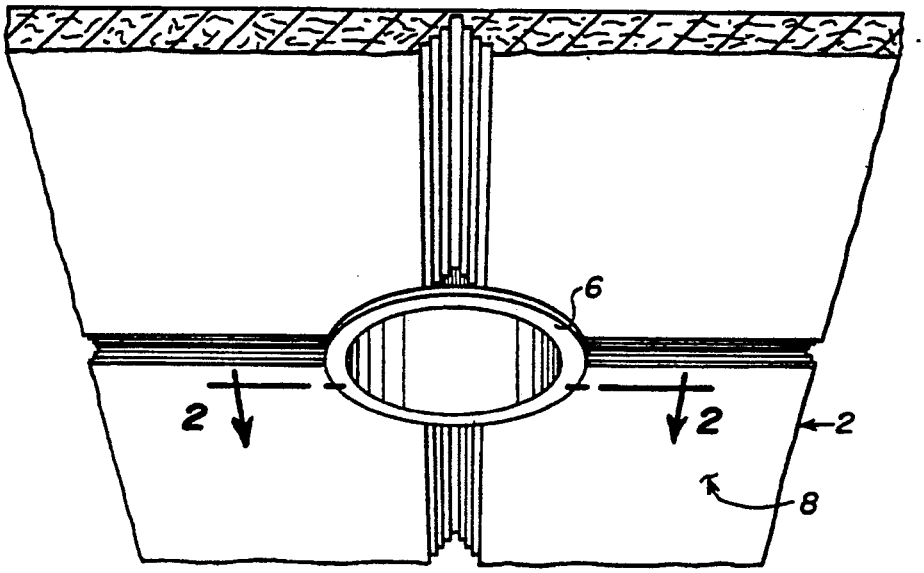
*Fig. 1*
PRIOR ART
*Fig. 2*
PRIOR ART
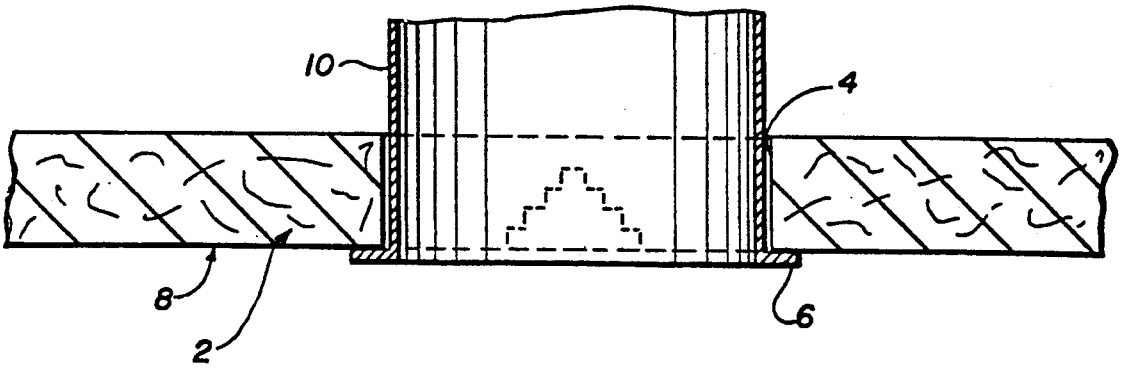

CEILING BOARD APERTURE

This is a continuation of application Ser. No. 536,350 filed on Jun. 11, 1990 now abandoned.

BACKGROUND OF THE INVENTION

1. Field of the Invention

The invention is directed to the construction of the aperture in a ceiling board through which is placed ceiling lights, air vents, etc.

2. Description of the Prior Art

Normally apertures for ceiling accessories such as lights, air vents, etc. are rough cut into the ceiling board in the field. The light fixture would be inserted into the rough cut aperture and a flange on the light fixture would conceal the rough cut aperture edges as shown in FIGS. 1 and 2.

DESCRIPTION OF THE DRAWINGS

FIG. 1 is a perspective view of a prior art light fixture mounting,

FIG. 2 is a cross-sectional view of the structure of FIG. 1 along line 2—2.

SUMMARY OF THE INVENTION

Figure 3:
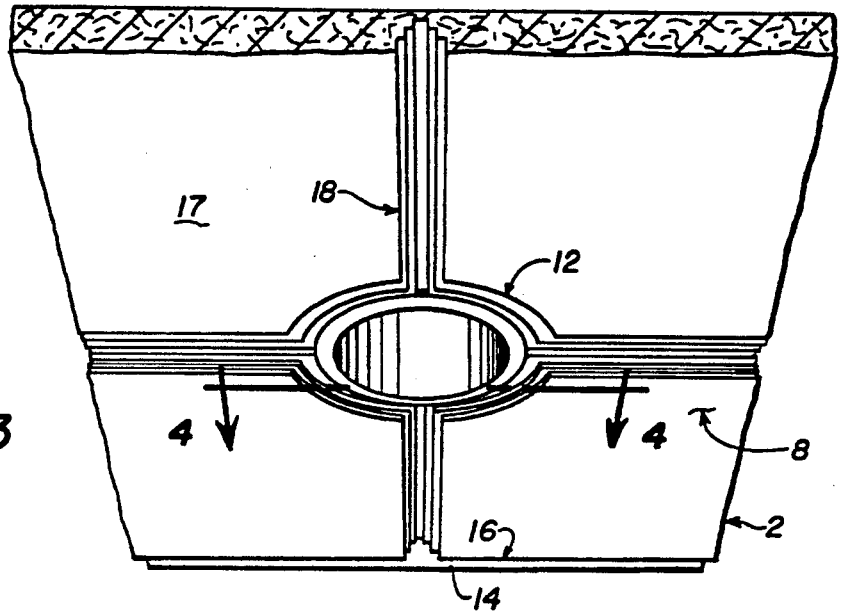
FIG. 3 is a perspective view of the invention herein.

The invention is a ceiling board with a factory cut aperture therein. The edges of the ceiling board and the edge(s) of the aperture are of the same or compatible configuration. The edge(s) of the aperture could conform only to the edge configuration of a design cut into the face of the board. The edge configuration is in two parts with a first decorative part adjacent the face of the board and the second part forming a flange surface at the midpoint of the thickness of the board. The decorative part could be a simple straight line, a curved line or a complex combination of straight and/or curved lines.

DETAILED DESCRIPTION OF THE INVENTION

The prior art is shown in FIGS. 1 and 2 wherein a board 2 is provided with a rough, field cut aperture 4 into which could be inserted a light fixture or other ceiling accessory. The accessory has a flange element 6 to cover the aperture opening on the finished face 8 of the board and the body 10 of the accessory extends through the aperture to the back of the board.

Figure 4:
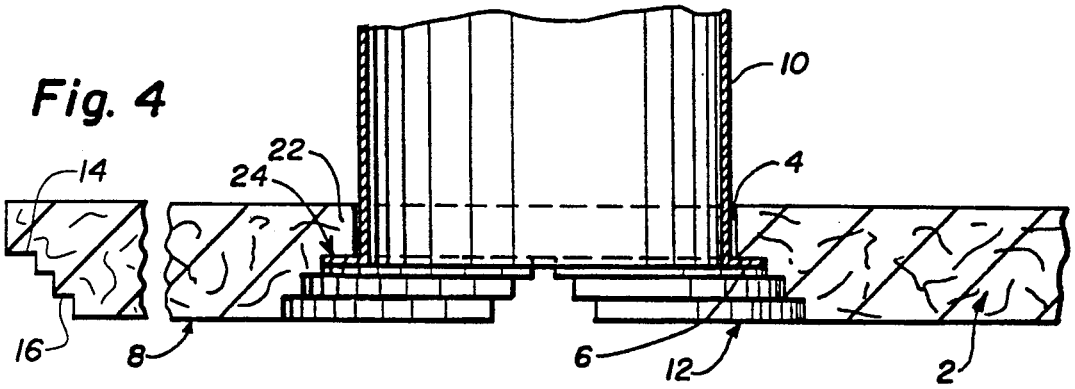
FIG. 4 is a cross-sectional view of the structure of FIG. 3 along line 4—4.
Figure 5:
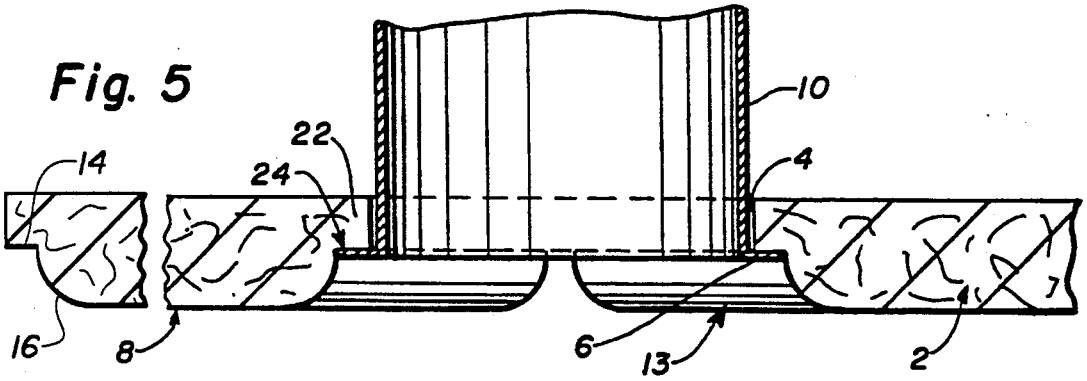
FIG. 5 is a cross-sectional view of an alternative edge configuration of the invention herein.

FIGS. 3–5 show the invention herein. The board 2 has an aperture 4 cut therein. The aperture would be cut in the board by a computer controlled routing machine since the first part 12 of the aperture would be part of the finished face of the board. A hand cut aperture in the field could not provide a good finish cut to the first part of the aperture and, therefore, a factory cut aperture must be precut in the board before it is sent to the point where the board is to be installed. The board would be at least twelve by twelve inches square and could be two feet by two feet square, a rectangular shape of two by four feet, or any other size normally used for ceiling boards. The board is normally about three-quarters of an inch thick, but could be the thickness of any currently used ceiling board. The board, in fact, could be any ceiling board capable of being cut with a router.

The board is normally formed with a flange 14 on its edge and a decorative specific edge configuration 16. The flange element 14 supports the board in the suspended ceiling system runners. The edge 12 or 16 gives a decorative effect to the board and this specific edge configuration 12 could be a straight line perpendicular to the flange element 14, a bevel edge, a stepped edge 12 (FIG. 4), a curved line 13 (FIG. 5) or any combination of the above. The board could also have a design 17 cut within the edges of the board to form a decorative specific edge configuration as shown as edge 18 of FIG. 3.

The aperture 4 (FIGS. 3–5) is a two-part edge structure. The aperture has one edge if the aperture is round. Other shapes for the aperture could result in plural sides forming plural identical edges for the aperture. The first part 12 of the aperture adjacent the finished face surface 8 of the board has a specific edge configuration the same as or compatible to the edge configuration 16 of the edges of the board and/or the edges of a design 18 cut within the edges of the board. The second part of the aperture is shown in FIGS. 4 and 5 as the flange 22. This flange 22 is the same shape and about the position as the flange 14 on the edge of the board. The flange 22 has a flange surface 24 parallel to the finished face surface 8 of the board with the flange surface 24 positioned about the midpoint of the board thickness.

FIG. 1 shows the flange element 6 of a light fixture resting on the surface 8 while the flange element 6 of FIG. 4 is resting on the flange surface 24 to provide a better appearance for the light fixture on the face of the board.

What is claimed is:

1. A ceiling board having a cut-away area to form an aperture therein forming an opening through the board comprising:

(a) a flat board with a top surface having a finished face surface and a bottom surface, said board being at least about twelve inches square at its face surface and about three-quarters of an inch thick from its top surface to its bottom surface, said board having four edges, the edges of the board from the top surface of the board to the midpoint of the thickness of the board being formed with a specific edge configuration, the edges of the board from the midpoint of the thickness of the board to the bottom of the board being a flange means with a surface parallel to the top surface of the board and extending outward from the edges of the board from the top surface of the board to the midpoint of the thickness of the board whereby the flange means supports the ceiling board in a ceiling suspension system and the face surface and specific edge configuration extend below the ceiling suspension system; and (b) an aperture means, with at least one edge forming an opening through the board with a part of the aperture edge precut before the board is sent to the point where the board is to be installed in a ceiling, said edge of the aperture means being in a first and second part, the first part of the aperture edge adjacent the top surface of the board having a specific aperture edge configuration the same as the specific edge configuration of the edges of the board from the top surface of the board to the midpoint of the thickness of the board, the second part of the aperture means spaced from the top surface of the board being a flange means with a surface parallel to the top surface of the board and extending into the opening of the aperture means, whereby a ceiling accessory rests on the flange means of the aperture and the aperture specific edge configuration is visible along with the specific edge configuration of the board edge from the area below the ceiling.

2. A ceiling board with an aperture therein as set forth in claim 1 wherein:

(a) the aperture edge configuration and specific edge configuration are stepped edge shape of at least one step between the finished face surface and the flange means.

3. A ceiling board with an aperture therein as set forth in claim 1 wherein:

(a) the aperture edge configuration and specific edge configuration are in part a curved surface.

4. A ceiling board with an aperture therein as set forth in claim 1 further comprising a specific edge configuration cut into the finished face surface wherein:

(a) the aperture edge configuration is in part the same as the specific edge configuration cut into the finished face surface.

5. A ceiling board with an aperture therein comprising:

(a) a flat board with a finished face surface, said board having four edges formed with a specific edge configuration; and (b) an aperture edge means forming an opening precut in the board before it is sent to the point where the board is to be installed in a ceiling, said aperture edge means being in a first and second part, the first part of the aperture edge means adjacent the finished face surface having a specific edge configuration the same as the specific edge configuration of the edges of the board, the second part of the aperture edge means spaced from the finished face surface being a flange surface means extending into the opening of the aperture edge means, both said specific edge configurations being visible to one below the ceiling when the board is installed in a ceiling suspension system.

* * * * *